United States Patent [19]

Komma et al.

[11] 4,132,261

[45] Jan. 2, 1979

[54] SUPPORT, DRIVE AND GUIDE ROLLER STAND FOR METAL STRAND CASTING PLANTS, PARTICULARLY FOR STEEL SLAB CURVED STRAND CASTING PLANT

[75] Inventors: Gerhard Komma, Dinslaken; Dieter Kothe, Moers; Werner Rahmfeld, Mulheim, all of Germany

[73] Assignee: DEMAG Aktiengesellschaft, Duisburg, Germany

[21] Appl. No.: 823,760

[22] Filed: Aug. 11, 1977

[30] Foreign Application Priority Data

Aug. 14, 1976 [DE] Fed. Rep. of Germany ..... 2636667

[51] Int. Cl.[2] ..... B22D 11/12

[52] U.S. Cl. ..... 164/448

[58] Field of Search ..... 164/82, 425, 426, 447, 164/448, 442, 441; 193/35 R; 226/189

[56] References Cited

U.S. PATENT DOCUMENTS 3,642,057 2/1972 Scheufele ..... 164/82X

FOREIGN PATENT DOCUMENTS 228886 10/1968 U.S.S.R. ..... 164/426

*Primary Examiner*—Francis S. Husar
*Assistant Examiner*—John S. Brown
*Attorney, Agent, or Firm*—Mandeville and Schweitzer

[57] ABSTRACT

The invention refers to a support, drive and guide roller stand for a metal strand casting plant, particularly for a steel slab curved strand casting plant, consisting of several segments with rollers and counter-rollers mounted in separate segment frames. Several rollers are arranged in one common segment frame, whereby one segment frame, carrying rollers, can be set for casting thickness and/or shrinking thickness relative to the segment frame carrying the counter-rollers, and whereby individual rollers are provided whose length is foreshortened vs. the strand width.

15 Claims, 13 Drawing Figures

1
2
3
4
8a
A
8b
9
7
8c
10
11a
8d
5
8e
I
11b
8f
I
6

12
11a 3b
3
BB
3a
11b
L 1
8a
8b
11a(11b)
8c
3
8d
8e
L
BB 1
8a
11a (11b)
8b
8c
3
8d
8e
L
BB 1
8a
8b
11a(11b)
8c
3
8d
8e
L
BB 3
16
11a(11b)
20
L
BB

SUPPORT, DRIVE AND GUIDE ROLLER STAND FOR METAL STRAND CASTING PLANTS, PARTICULARLY FOR STEEL SLAB CURVED STRAND CASTING PLANT

BACKGROUND OF THE INVENTION

This type of roller stand supports a cast strand coming from a strand casting mold hardened into a thin strand shell at its outer layers only, surrounding a liquid core. The liquid core extends up to the guide roller stand in a strand casting plant with support roller stand succeeding the strand casting mold, and with a drive roller stand. Consequently, the rollers must accommodate pressures from the interior directed against the strand shell from the ferrostatic pressure of the liquid metal and/or steel column depending upon their elevation level. Despite interior and exterior cooling they are subject to additional stress due to temperature change with each rotation. The roller diameter is essentially determined by bending stress and elastic flexure for rollers supported at each end in rotary bearings located outside the strand width. The roller diameter is to be kept as small as possible in order to reduce expenditures in connection with initial costs and stocking of the rollers.

The roller diameter depends primarily on the material used for the rollers and on the maximum width of the casting strand, that is, the spacing between the rotary bearings for the rollers. As a rule, the support width can be calculated on the basis of the sum of maximum casting strand width, transition from the roller body to the roller support pin, and one bearing width.

It is known in German disclosure 2 420 514 to use support rollers divided into roller sections with several bearings across the strand width rather than continuous support rollers in order to achieve casting of strands of greater width and higher casting speed. The cooling of divided support rollers, however, is made more difficult by individual roller sections which are not engaged by the strand, so that special measures must be taken in order to avoid standstill of individual roller sections. Furthermore, divided support rollers can easily dent the casting strand surface with their end edges and leave flaws affecting the quality of the cast material. The problem of eliminating strong flexure and/or great stress in support rollers is not solved by division into roller sections.

It is also known in German Trade Mark 69 28 827 that at least a number of rollers show a length which is at the most 500 mm smaller than the optimum width of the casting strand produced in the strand casting plant. The known solution only considers a part of the practical conditions of the respective state of solidification of a casting strand. Thus, over the entire length of the strand rollers of uniform length, they do not sufficiently support the casting strand in the upper part of the strand which is still hot, whereas the casting strand has too much support in the lower part which is already cooled.

STATEMENT OF THE INVENTION

It is the object of this invention to create a roller arrangement for wide casting strands of a width such as 2,600 mm and over, for example. The roller diameter is to be kept at a minimum while maintaining continuous rollers resting in bearings at the ends. Bending stress is to be decreased without running the risk of damaging the cast material.

The invention solves this by determining the length of the rollers in at least one, preferably several locations in the area of support along the strand in accordance with the equation $L = BB - (2.5 \text{ to } 5 \cdot SD)$, whereby L is length (of body) of roller in mm; BB is maximum slab width of the strand casting plant in mm; SD is the thickness of the strand shell in mm at the respective location in the area of the support roller stand from the strand casting mold outlet to drive roller stand inlet with reference to maximum casting speed of the particular installation.

With this formula for roller length based on practical values, the laws of metallurgy can be fulfilled in a more advantageous manner than heretofore. The cooling conditions of the respective cast metal determines the length of support depending upon the location of support. The invention allows economies in roller length in areas where previously the length was given by the width of the strand or defined by a constant factor.

This concept can be transferred, with certain modifications, from the support area of the metal strand casting plant to drive and guide areas thereof. The calculation of the roller length in the area of drive and guide roller stands is based in at least several locations in the drive and guide area on the equation $L = BB - (3.5 \text{ to } 4 \cdot SD)$, whereby SD is the thickness of the strand shell in mm at the first roller when entering the drive and guide roller stand.

Support, drive and guide rollers calculated in accordance with the formula permit utilization of the advantages of a continuous roller coupled with a smaller diameter making it possible in numerous locations along the course of the strand to save expenditures for the rollers. In turn, this saving permits, due to the shortening of the rollers, easier accessibility to the casting strand, making it easier to install related equipment, such as, for cooling. Based on the calculated lengths of the rollers the invention allows a variety of arrangements, several of which will be specified.

The fact that all rollers within a segment, or within the drive and guide area of the strand course may conform to the length calculated according to a selected location, simplifies and reduces cost of stocking. Furthermore, safe support coupled with favorable stocking is ensured by adapting all rollers within a segment or within the drive and guide area of the strand course to the length calculated for the first roller.

The invention can be applied to selected sections of the metal strand casting plant in such a way that all rollers in several segments succeeding along the strand course forming groups of equal construction and/or in the drive and guide area are of the identical foreshortened length according to the invention. It is recommended for cast metals such as some steel qualities that present difficulties in cooling, to provide rollers of calculated length for the casting strand in the support roller stand only in the immediate vicinity of the drive and guide roller stand. Should there be any danger of ruptures in the strand in several locations along the course of the strand allowing liquid metal to pour from the strand rendering the strand casting plant useless in many places, it would be advantageous to arrange between groups of rollers of calculated foreshortened length according to the invention one individual or a group of several rollers whose length matches the strand width. Rollers whose length corresponds to the width of the strand have the same function between the remaining foreshortened rollers as the support given to a bridge by piers, whereby, unlike the bridge, additional piers in the form of the foreshortened rollers are provided between the piers.

Transfer forces can be transmitted advantageously by connecting the rollers whose length corresponds to the strand width to a rotary drive. Rotary drive transmission thus takes place with maximum frictional force on the casting strand. The principle of the invention of adapting the rollers in selected sections of the support roller stand or drive and guide roller stand to various factors occurring in the casting operation can be carried even further. Depending upon the cooling diagrams required, and the resulting intensity it is also suggested to have one or several groups of rollers of a length matching the strand width followed by one or several groups of rollers of calculated foreshortened length which are assembled at the segment frames.

The principle of the invention can be applied to the section of the drive and guide area as well. In this part of the strand casting plant, the casting strand is largely solidified. However, at very high speeds liquid portions can be found in the cross section of the casting strand in the drive as well as guide stand. The length of the rollers can be adapted in such a way that in the bending zone of a curved strand casting plant, i.e. in neighboring areas or transitional of drive and guide course, rollers of a length matching the strand width are provided, and that the remaining rollers of the drive and guide area have the calculated foreshortened length.

The drive and guide roller stand can be simplified in that the counter-roller for a driven roller shows a length according to the strand width, and a non-driven roller has a calculated foreshortened length. Due to the extensive solidification of the exterior zones of the casting strand cross section it is also possible to provide only the rollers in the bending point area from the curve to the straight of a curved strand casting plant with calculated foreshortened lengths.

If the drive and guide roller stand is to be of the known type with roller lengths corresponding to strand width, it is nevertheless feasible to provide rollers with calculated foreshortened lengths according to the invention in the area before and behind the bending point from the curve to the straight in a curved strand casting plant. The drive and guide roller stand can also be designed so that all rollers up to the start of the straight in the guide area are of the calculated foreshortened lengths. The guide course itself consists of a row of rollers whose length matches the strand width. These rollers thus have a smoothing effect on the largely straight strand. The invention does not have to be restricted to one side of the rollers in a metal strand casting plant. It could be advantageous to provide roller and counter-roller with the calculated foreshortened length.

Several examples of the invention are shown schematically in the drawings and are described as follows:

DETAILED DESCRIPTION OF THE INVENTION

Figure 1:
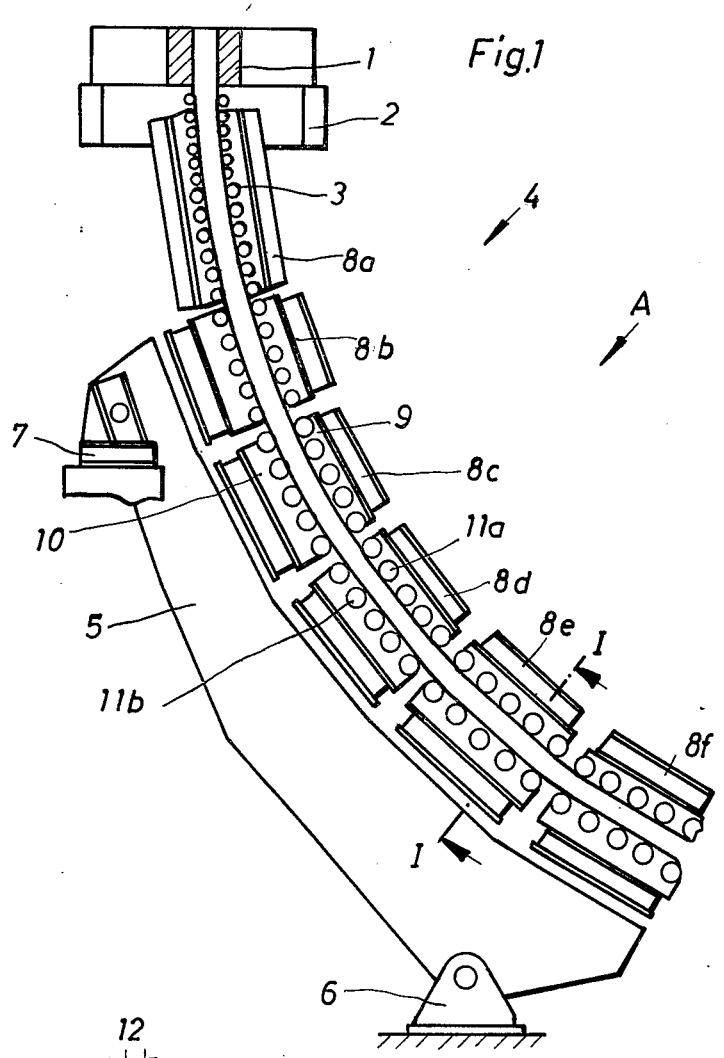
FIG. 1 is a schematic view in side elevation of a support roller stand in a steel slab curved strand casting plant illustrating aspects of the invention.

The liquid casting metal is cast in charge or sequence operation into the strand casting mold 1 which is secured in the oscillating lift table 2. Casting strand 3 solidified outside and liquid inside leaves strand casting mold 1, and is cooled by means of spray nozzles (not shown) with water or other media while travelling through support roller stand 4. Support roller stand 4 consists mainly of a banana-shaped beam 5 resting on foundations 6 and 7, and supporting individual segments **8*a* to 8*f* which are interchangeably affixed to beam 5**.

Each segment **8*a* to 8*f* consists of two segment frames 9 and 10, the latter each carrying a row of rollers 11*a* and counter-rollers 11*b*. The number of rollers is usually the same for segments 8*b* to 8*f* and it is greater in segment 8*a* following the strand casting mold 1. Depending upon the size of the radius formed by the curved strand casting plant, the number of segments and rollers with counter-rollers may be smaller or larger. One of the segment frames 9 or 10 is adjustable vs. the other segment frame. Rollers 11*a* and counter-rollers 11*b*** form the strand vein or path in their operating position during the casting process.

Figure 2:
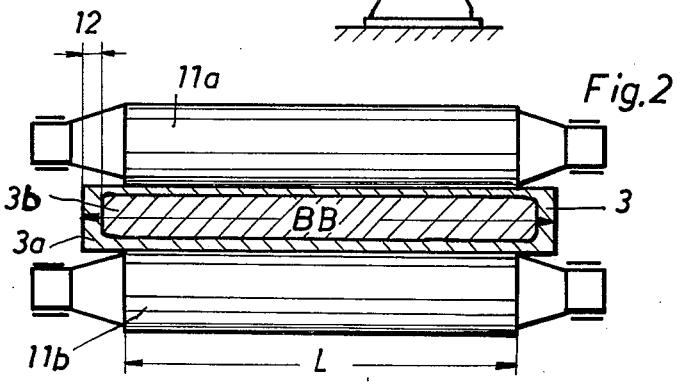
FIG. 2 is a cross-sectional view along lines I—I of FIG. 1.
Figure 3:
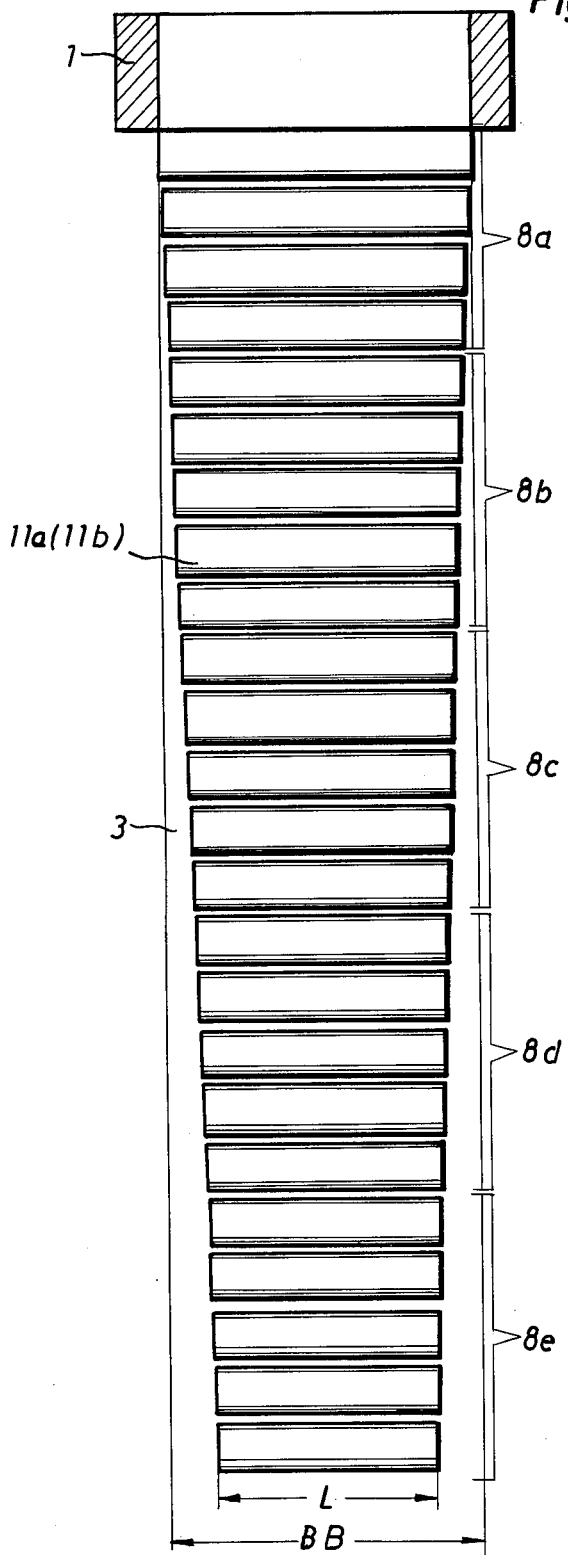
FIGS. 3–8 illustrate representative roller layouts for six different applications of the invention, as viewed in the direction of arrow A in FIG. 1.

According to FIG. 2, the exterior of casting strand 3 has solidified to form a thin strand shell **3*a*. The following description is based on the standard 12 as "strand shell thickness SD". This strand shell thickness increases more or less continuously with growing distance from the strand casting mold and does so at a different rate depending upon different casting metal properties (steel analysis), and different casting velocities. The width of the casting stand is indicated by BB (slab width) and the length of the roller by L. The hatched area representing the liquid cast metal 3*b*** diminishes with progressive cooling and solidification in accordance with cooling diagrams used for planning the strand casting plant based on chemical composition of the casting metal.

Figure 4:
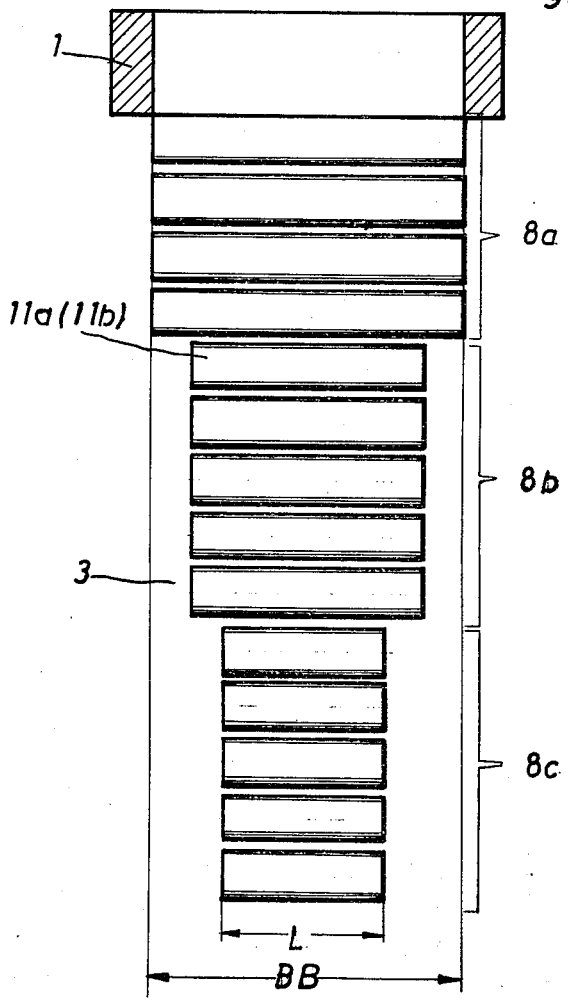

The length of rollers **11*a* and/or counter-rollers 11*b* within the support roller stand 4 in FIG. 4 has been calculated in accordance with the equation as per the invention $L = BB - (2.5 \text{ to } 5 \cdot SD)$ so that strand shell SD increases roughly as a wedge shape with respect to the cooling diagram of the respective type of casting metal. For casting strands which are initially slow in cooling, but increase their cooling rate thereafter, the support roller stand in segment 8*a* is provided with support rollers 11*a* and/or 11*b* of normal length (FIG. 4), followed by two segments 8*b* and 8*c*** whose support rollers are calculated in two stages in accordance with the formula of this invention.

Figure 5:
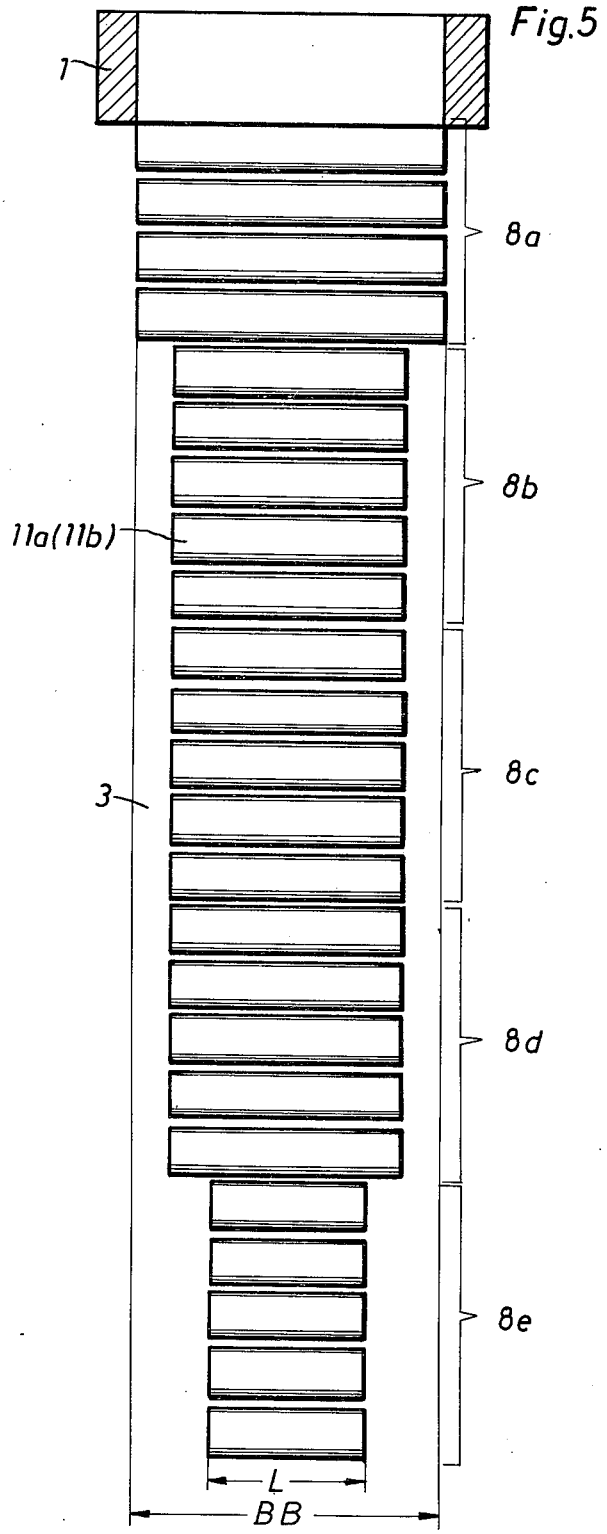
Figure 6:
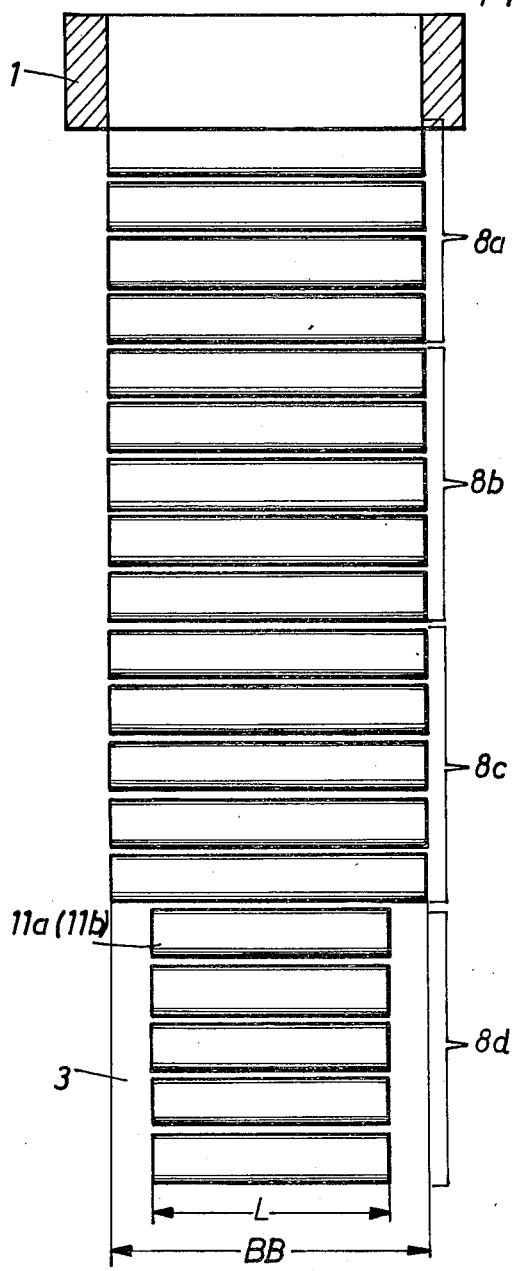

In another example (FIG. 5), segment **8*a* with support rollers whose length matches the width of strand BB, is followed by a center part consisting of identical segments 8*b*, 8*c*, 8*d*. This center part forms a relatively mild staggering of segments when compared to previous examples. The arrangement of rollers according to FIG. 6 is provided for extremely sensitive casting metals which are slow in cooling. Segments 8*a*, 8*b*, 8*c* show normal lengths for the support rollers 11***a*, 11*b*, while only segment 8*d* has support rollers foreshortened in conformity with the formula of this invention. Thus, in accordance with the principle of the invention, the first stage of roller foreshortening is still further delayed compared to the example given in FIG. 5.

Figure 7:
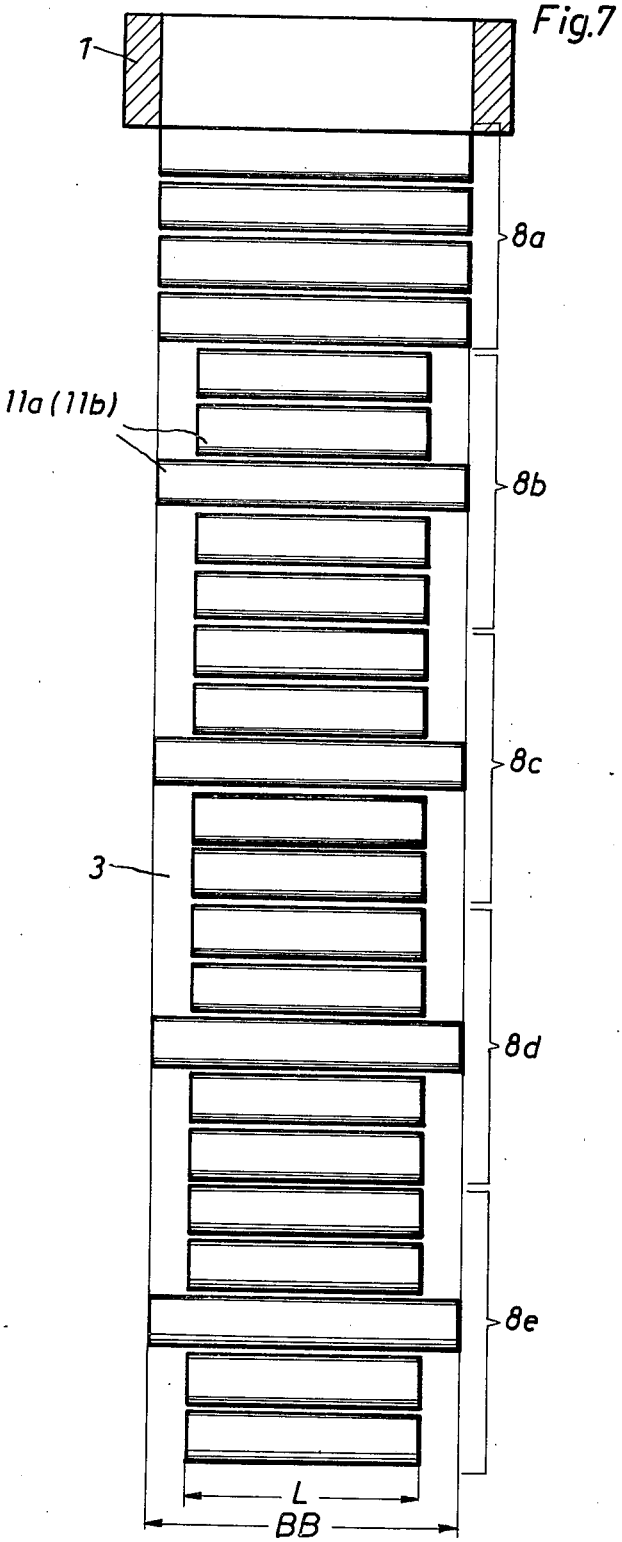
Figure 8:
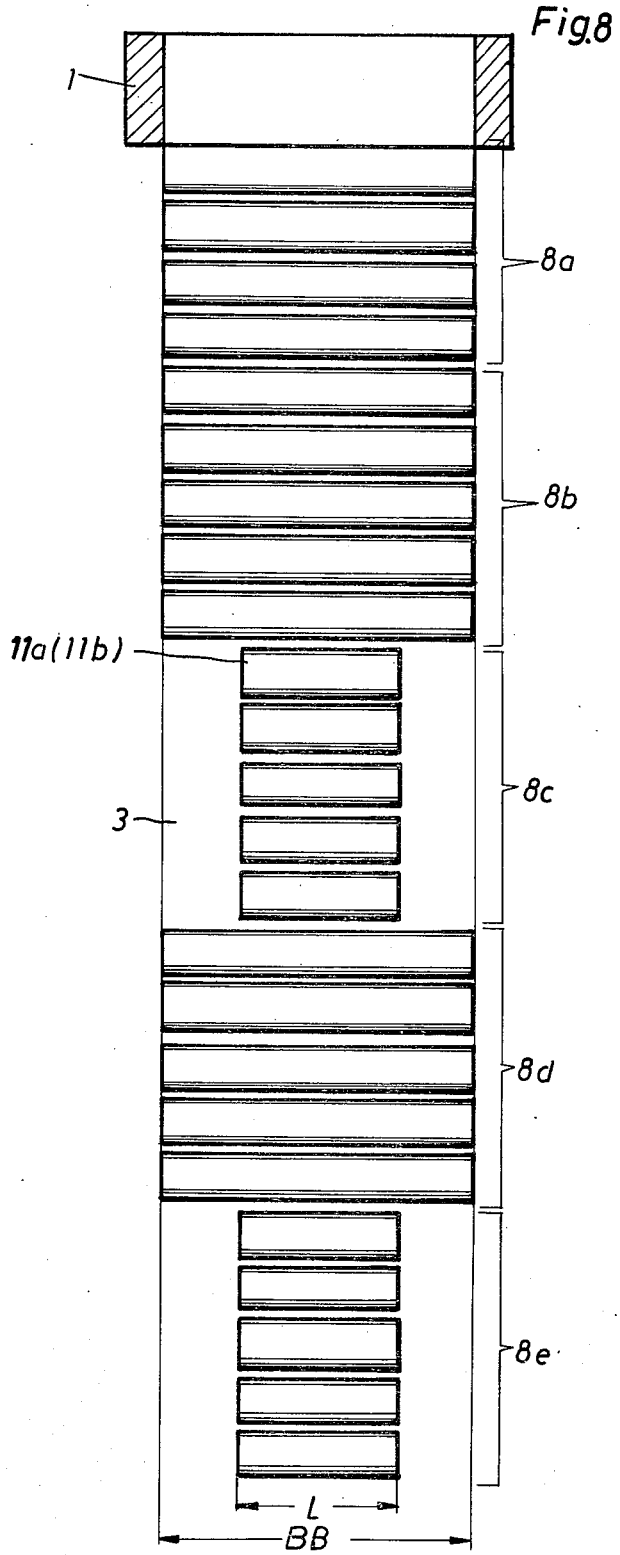
Figure 9:
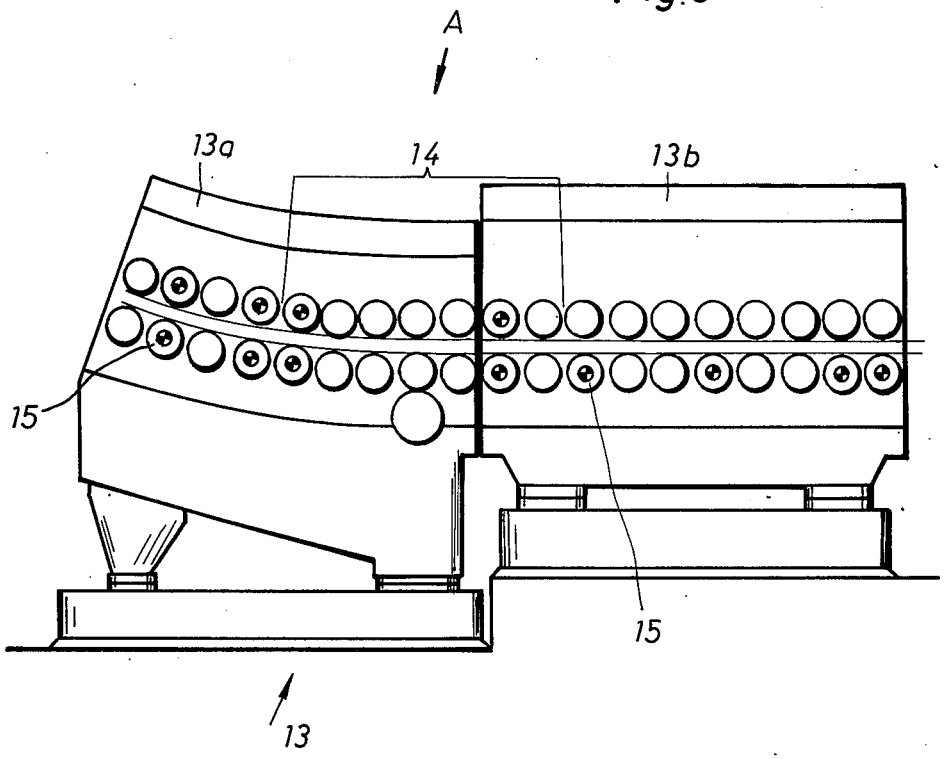
FIG. 9 is a schematic side elevational view of a drive and guide roller stand illustrating aspects of the invention.
Figure 10:
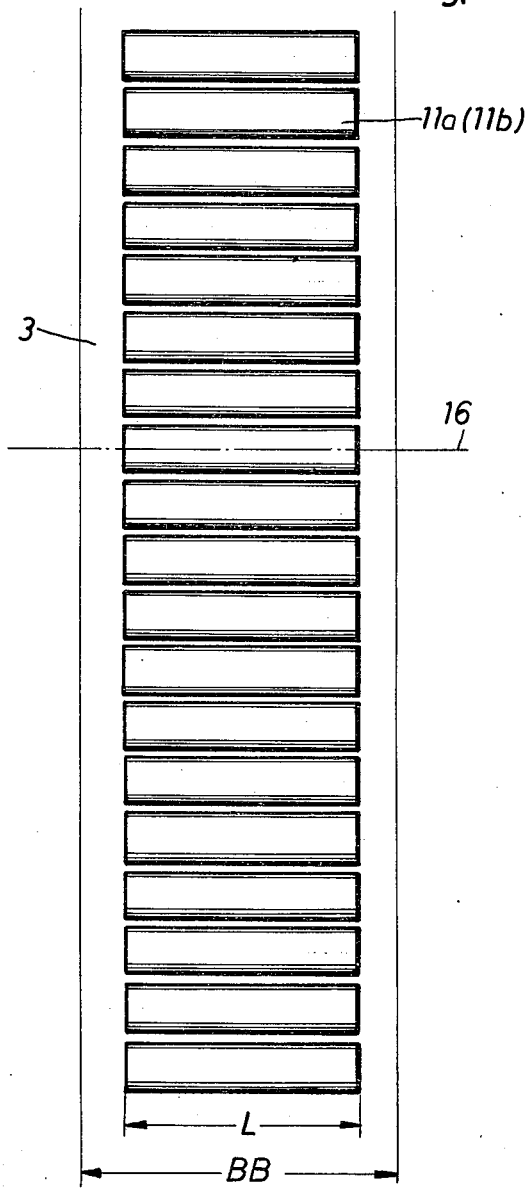
FIGS. 10–13 are illustrative roller layouts for four different types of applications of the invention, and particularly in the drive and guide roller areas of a steel slab curved strand casting plant.

The lengths L calculated with the formula of the invention may be kept relatively short if within one of segments 8*b* to 8*e* one support roller 11*a* and/or 11*b* each has a length L matching the strand width BB (FIG. 7). This example is a repetition of stages of roller foreshortening formed by intermediary arrangement of rollers whose length matches the strand width. In a support roller stand 4 consisting of segments 8*a*, 8*b* and 8*d* with support rollers 11*a* and/or 11*b* whose length L covers the entire strand width BB, it is possible to create areas of decreased stress on the strand shell by placing segments 8*c* and 8*e* between the segments mentioned above (FIG. 8). Such a system results therefore in two inserted stages of segments of uniform roller length. Drive and guide roller stand 13 (FIG. 9) is divided into drive area 13*a* and guide area 13*b*. Both form the bending zone 14 in a transition area. Markings 15 indicate driven rollers within the drive area 13*a* and the guide area 13*b*. Roller layout of FIG. 10 provides the same foreshortened length L calculated with the formula of the invention for all drive and guide rollers 11*a* and/or 11*b*. This system thus constitutes a single-stage continuous foreshortening of roller lengths within the drive and guide roller stand.

Figure 11:
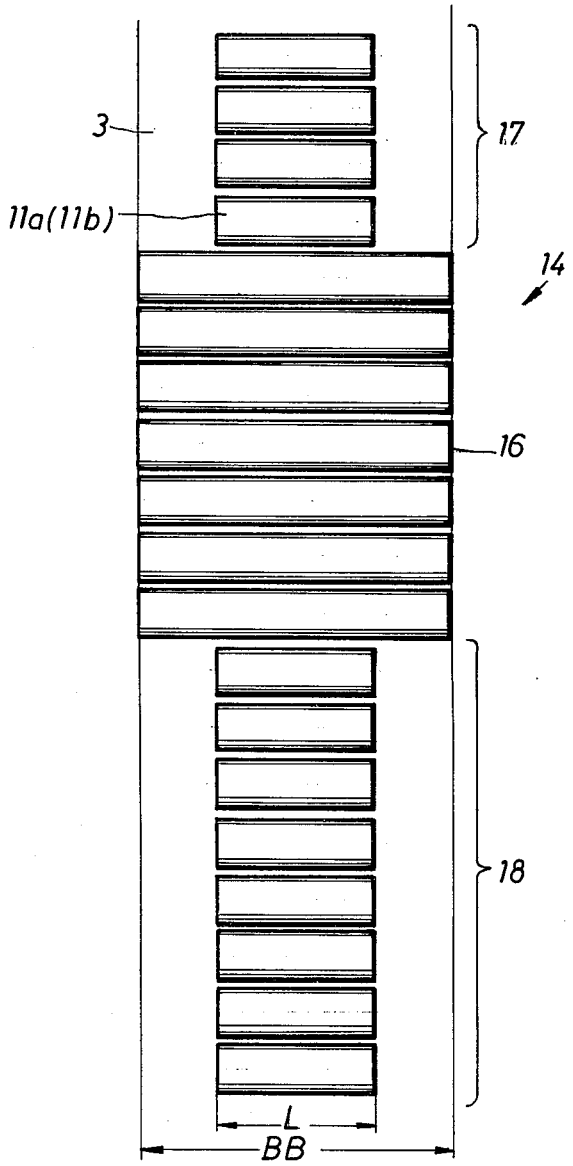
Figure 12:
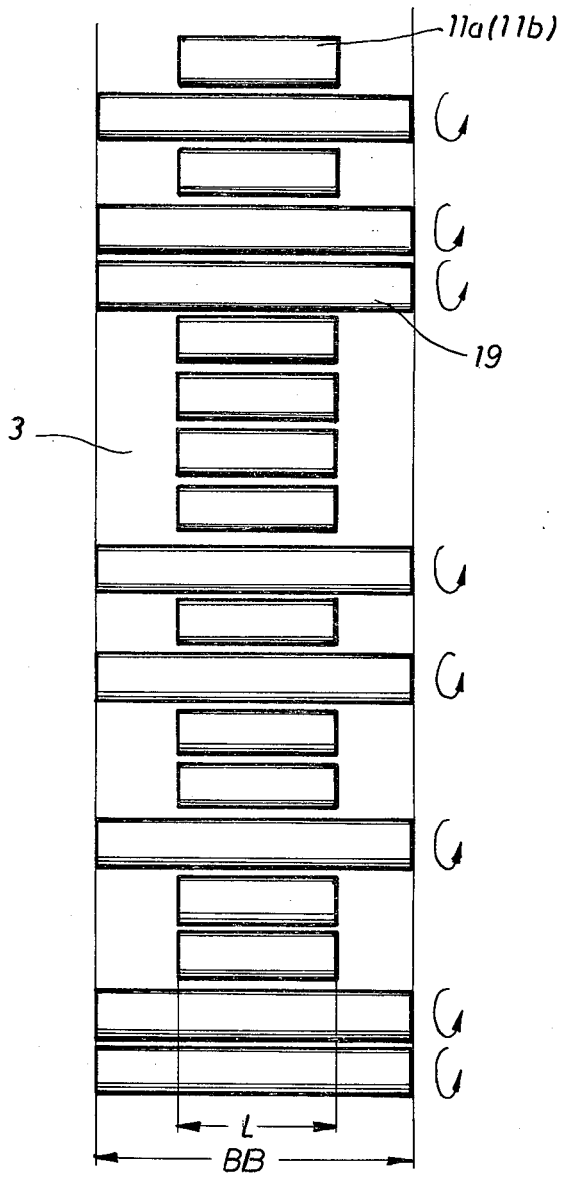

The roller layout of FIG. 11 shows before and after bending point 16 drive and guide rollers of a length matching the strand width BB. Before and after the bending zone 14 thus formed are groups 17 and 18 with drive and guide rollers 11*a* and/or 11*b* whose lengths L are calculated by the formula of the invention. In another design for drive area 13*a* and guide area 13*b* (FIG. 12) only non-driven drive and guide rollers 11*a* and/or 11*b* are calculated by the formula of the invention, whereas driven drive and guide rollers 19 are provided with a length matching the strand width BB.

Figure 13:
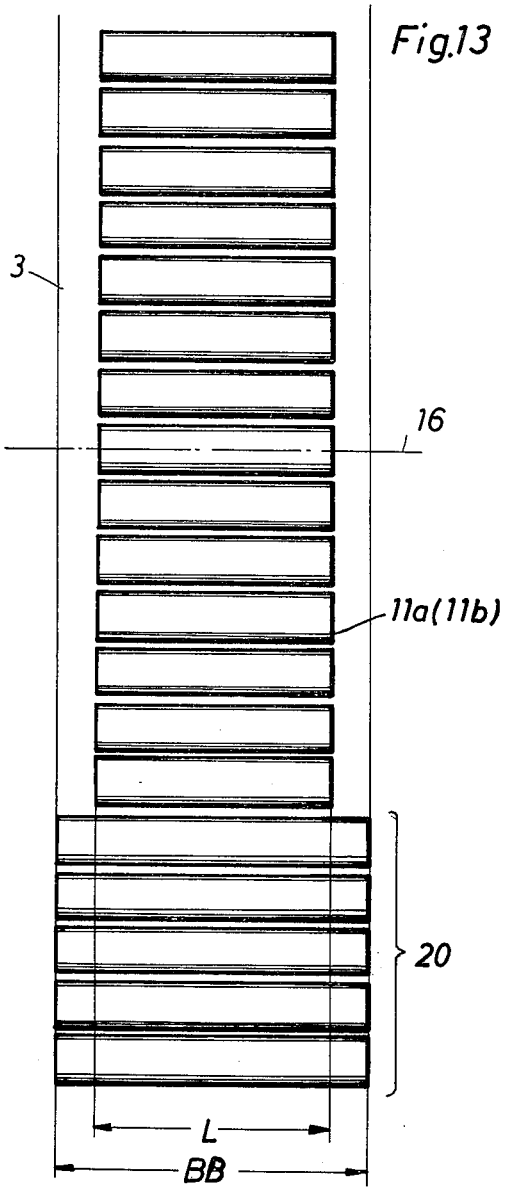

According to FIG. 13, a uniform length L of the partially driven and not driven drive and guide rollers 11*a* and/or 11*b* before and after bending point 16, i.e. within the bending zone 14 as well. The latter part 20 of guide rollers 11 has a length matching the strand width BB. This part 20 serves to smooth out the straightened cast strand which is usually thoroughly solidified by now.

I claim:

1. In roller stand apparatus for a metal strand casting plant, particularly a steel slab curved strand casting plant, and having (a) a plurality of roller segments;

(b) each said segment including a pair of opposed segment frames;

(c) each pair of opposed segment frames carrying a plurality of rollers and counter-rollers;

(d) said opposed rollers and counter-rollers in said plurality of roller segments defining a cast strand path sequentially of support, drive and guide rollers; the improvement characterized by (e) the length of at least some of said support rollers in said support roller area of said path being determined in accordance with the equation $L = BB - (2.5 - 5 \cdot SD)$ wherein (1) L is the length of said support rollers in paragraph (e) in millimeters, (2) BB is the maximum strand width in millimeters, (3) SD is the thickness of the strand shell in millimeters at the location of the roller or rollers whose length is being determined; and (f) said strand thickness (SD) is based upon the maximum casting speed of said roller stand.

2. The apparatus of claim 1, further characterized by (a) the length of at least some of said drive and guide rollers in said drive and guide roller areas of said path being determined in accordance with the equation $L = BB - (3.5 - 4 \cdot SD)$, wherein (1) L is the length of said drive and guide rollers in paragraph (a) in millimeters, (2) SD is the thickness of a strand shell in millimeters at the first roller in said path in the drive roller area.

3. The apparatus of claim 1, further characterized by (a) the length L of all said support rollers in one segment of said support roller area of said stand being calculated at one selected location.

4. The apparatus of claim 1, further characterized by (a) only said support rollers immediately prior to said drive roller area of said path are of a length L.

5. The apparatus of claim 1, further characterized by (a) the length L of all said drive and guide rollers in said drive and guide roller areas of said stand being calculated at one location.

6. The apparatus of claim 2, further characterized by (a) the length L of all said support rollers in one segment of said support roller area of said path are equal to the length of the first roller in said segment in said path based upon the position of said first roller; and (b) the length L of all said drive and guide rollers in the drive and guide roller areas of said path are equal to the length of the first drive roller based upon the position of said first drive roller.

7. The apparatus of claim 6, further characterized by (a) the length of all said support rollers in all segments forming said support roller area are of said equal length.

8. The apparatus of claim 2, further characterized by (a) one or more rollers of strand width BB are positioned between one or more rollers of the length L in said support, drive and guide roller areas.

9. The apparatus of claim 8, further characterized by (a) said rollers of a strand width BB are connected to a rotary drive for said stand.

10. The apparatus of claim 9, further characterized by (a) the said counter-rollers for a roller connected to said rotary drive are of a length BB.

11. The apparatus of claim 2, further characterized by (a) each segment frame includes one or more rollers of a length L, followed by one or more rollers of a length BB.

12. The apparatus of claim 1, further characterized by (a) one or more rollers of a length BB are provided before and after the transition point between said drive and guide areas of said path; and (b) the remaining rollers of said drive and guide areas are of a length L.

13. The apparatus of claim 1, further characterized by (a) only all the rollers in the drive area of said path are of a length L.

14. The apparatus of claim 2, further characterized by (a) all said rollers in the support and drive areas of said path are of a length L; and (b) all said rollers in said guide area are of a length BB.

15. The apparatus of claim 2, further characterized by (a) all said counter-rollers are of a length L when their respective rollers are of a length L.

* * * * *